US011859353B2

(12) United States Patent
Frelich et al.

(10) Patent No.: US 11,859,353 B2
(45) Date of Patent: Jan. 2, 2024

(54) END GATE STOWAGE APPARATUS FOR SCREED OF A PAVER

(71) Applicant: Caterpillar Paving Products Inc., Brooklyn Park, MN (US)

(72) Inventors: Toby A Frelich, Saint Michael, MN (US); Bee Vang, Fridley, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 247 days.

(21) Appl. No.: 17/329,372

(22) Filed: May 25, 2021

(65) Prior Publication Data

US 2022/0380988 A1 Dec. 1, 2022

(51) Int. Cl.
*E01C 19/40* (2006.01)

(52) U.S. Cl.
CPC ..... *E01C 19/40* (2013.01); *E01C 2301/16* (2013.01)

(58) Field of Classification Search
CPC ..... E01C 19/40; E01C 2301/16
USPC ..... 404/72, 118
See application file for complete search history.

(56) References Cited

U.S. PATENT DOCUMENTS 1,308,189 A * 7/1919 Moxey ..... E06B 9/52 160/217
3,680,451 A * 8/1972 Birtchet ..... E01C 19/187 404/104
4,948,292 A * 8/1990 Haven ..... E01C 19/008 404/84.2
5,590,977 A 1/1997 Guntert, Jr. et al.
6,203,243 B1 * 3/2001 Birtchet ..... E01C 19/42 404/104
7,121,763 B1 10/2006 Young et al.
D820,324 S * 6/2018 Ewringmann ..... D15/19

FOREIGN PATENT DOCUMENTS

DE 10040761.7 12/2001
EP 0879918 11/1998

* cited by examiner

*Primary Examiner* — Raymond W Addie
(74) *Attorney, Agent, or Firm* — Schwegman Lundberg & Woessner, P.A.

(57) ABSTRACT

According to one example, a screed assembly for a paver is disclosed. The screed assembly can include an end gate, a screed extender and a stowage apparatus. The screed extender can be selectively connected to the end gate via a first one or more quick attachment mechanisms. When connected, the screed extender can be configured to operably position the end gate relative to a main screed. The stowage apparatus can have a second one or more quick attachment mechanisms for selectively coupling the stowage apparatus to the end gate. The stowage apparatus can be movable from a first position for transportation of the paver where the end gate is coupled to the stowage apparatus and the end gate is positioned behind the main screed to a second position during operation of the paver where the end gate is decoupled from the stowage apparatus and the stowage apparatus is positioned adjacent the main screed.

20 Claims, 12 Drawing Sheets

END GATE STOWAGE APPARATUS FOR SCREED OF A PAVER

TECHNICAL FIELD

The present application relates generally to apparatuses, methods and systems that enable stowage of an end gate of a screed assembly for transport. More particularly, the present application relates to an apparatus, method and system for quickly and easily connecting and disconnecting the end gate to enable stowage and use thereof.

BACKGROUND

Pavers or paving machines are working machines used in a paving process to create a new road surface. Such pavers assist in pouring and spreading paving material to form a new roadway surface or mat. With asphalt pavers, an aggregate filled bituminous mixture that comprises the paving material is spread while hot and is then compacted so that a hardened pavement surface is formed upon cooling. Pavers typically utilize a heavy assembly termed a "screed" that is drawn behind the paving machine. The screed assembly includes one or more replaceable screed plates to spread a smooth even layer of paving material on the prepared roadbed. The weight and/or a vibration of the screed assembly aids in compressing the paving material and performing initial compaction of the paving material layer.

To facilitate laying of the paving material, the screed assembly can have a number of components including a number of screed plates. These can be separate from one another and can be extended and retracted laterally relative to the direction of travel of the paver. This ability to use multiple screed plates to cover a larger lateral area allows a greater area to be paved more efficiently with a reduced number of passes. Furthermore, having multiple independent screed plates as part of the screed assembly can allow for changes in a relative angle of the screeds individually. This can allow the mat in certain areas to be provided with a desired angle, curvature or gradient as desired. This can allow a water drainage gradient to be introduced to the mat, for example. Various screed assemblies having multiple screed plates are known and include a front mount screed extension assembly and a rear mount screed extension assembly. With the front mount screed extension assembly, one or more side screed plates are positioned laterally of and in front of a main screed plate. With the rear mount screed extension assembly, one or more side screed plates are positioned laterally of and behind the main screed plate.

When transporting construction equipment local laws and restrictions must be adhered to, some of which set a maximum width for equipment traveling on public roadways. However, these regulations run counter to a desire to have asphalt paver screed assembly have of a maximum lateral width for improved efficiency when paving roads. As a result, there is sometimes a need to stow certain components of the asphalt paver screed assembly during transport in order to meet transportation requirements.

Stowage of screed assembly components such as the end gate to reduce lateral width of the screed assembly is recognized in U.S. Pat. No. 7,121,763. However, this stowage design does not utilize a stowage apparatus to facilitate stowing the end gate. Rather, each end gate must be removed from a screed extender and reattached to the screed assembly in another location. This process can be tedious and time consuming.

SUMMARY OF THE INVENTION

In one example, a screed assembly for a paver is disclosed. The screed assembly can include an end gate, a screed extender and a stowage apparatus. The screed extender can be selectively connected to the end gate via a first one or more quick attachment mechanisms. When connected, the screed extender can be configured to operably position the end gate relative to a main screed. The stowage apparatus can have a second one or more quick attachment mechanisms for selectively coupling the stowage apparatus to the end gate. The stowage apparatus can be movable from a first position for transportation of the paver where the end gate is coupled to the stowage apparatus and the end gate is positioned behind the main screed to a second position during operation of the paver where the end gale is decoupled from the stowage apparatus and the stowage apparatus is positioned adjacent the main screed.

In another example, a system for a paver is disclosed. The system can include a main screed, an end gate, a screed extender, a stowage apparatus, a plurality of quick attachment mechanisms. The screed extender can be configured to selectively couple with the end gate. The stowage apparatus can be configured to selectively couple with the end gate and the main screed. The stowage apparatus can be configured to be movable from a first position for transportation of the paver where the end gate is coupled to the stowage apparatus and the end gate is positioned behind the main screed to a second position during operation of the paver where the end gate is decoupled from the stowage apparatus and the stowage apparatus is positioned adjacent the main screed. The plurality of quick attachment mechanisms can selectively couple at least one of the end gate to the screed extender or the end gate to the stowage apparatus.

In another example, a method of stowing an end gate of a screed assembly for transport is disclosed. The method can include connecting the end gate to a stowage apparatus using one or more quick connect mechanisms, disconnecting the end gate from a screed extender, and pivoting the stowage apparatus to position the end gate behind the main screed.

DETAILED DESCRIPTION

Figure 1:
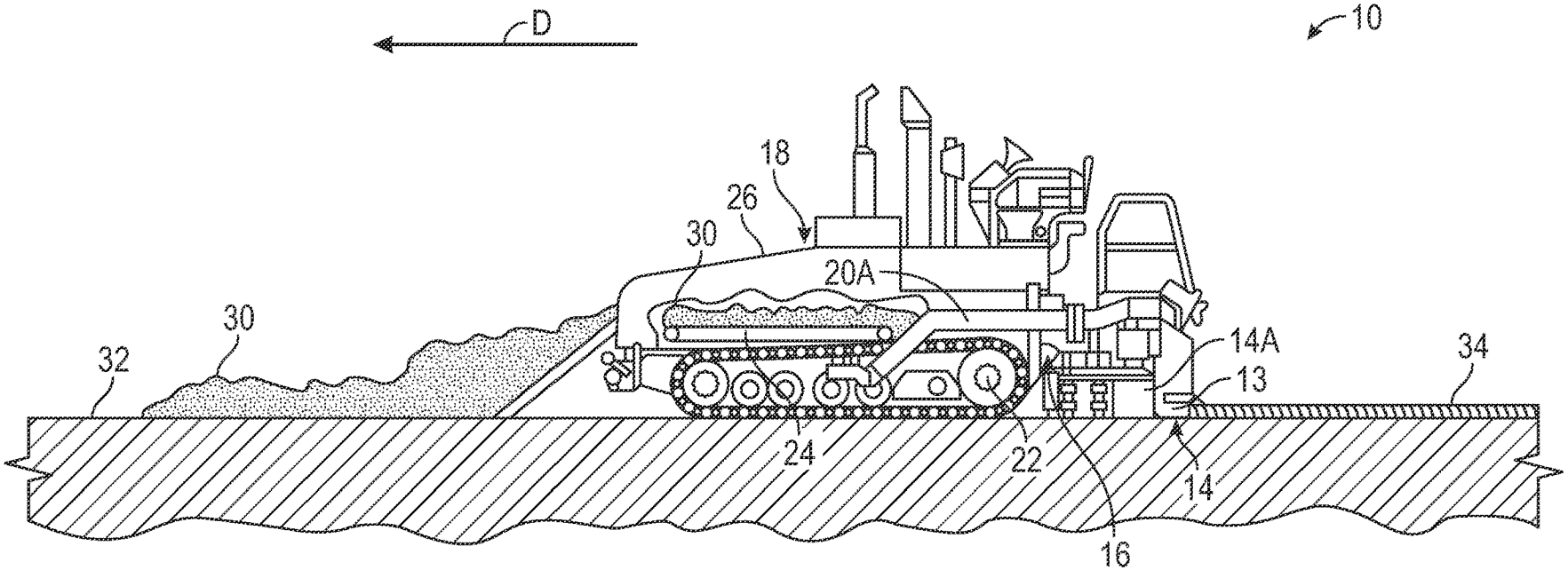
FIG. 1 is a schematic side view of an asphalt paving machine showing a screed assembly according to an example of the present application.

FIG. 1 is a schematic side view of an asphalt paving machine 10 showing a screed assembly 14 positioned rearward of an auger system 16. The asphalt paving machine 10 can comprise a vehicle portion 18, which can be connected to the screed assembly 14 via a tow arm 20A. The screed assembly 14 can additionally include an end gate 14A and a main screed plate 13. A second tow arm (not shown) can also be provided in some cases. The vehicle portion 18 can additionally comprise a propulsion element 22, a conveyor system 24 and a hopper 26.

The paving material 30 can be asphalt, aggregate materials or concrete. In various embodiments, the paving material 30 can be deposited directly into the hopper 26 of the paving machine 10. The paving machine 10 can travel in direction D, while the conveyor system 24 can move paving material in the opposite direction from the hopper 26 to the auger system 16.

The conveyor system 24 can be disposed within or below the hopper 26. The conveyor 26 can transport the loose paving material 30 through the vehicle portion 18 toward the auger system 16. A grading implement, such as the screed assembly 14, can be attached to the rear of the vehicle portion 18 to receive the paving material 30 from the auger system 16. The screed assembly 14 can be towed by tow arms 20A, only one of which is shown in FIG. 1. The propulsion system 22 can comprise a ground engaging element, such as an endless track as shown in FIG. 1, wheels or the like for propelling the paving machine 10 along the work surface 32. The loose paving material 30 can be deposited by the conveyor system 24 in front of the auger system 16. The auger system 16 can disperse the loose paving material 30 along the width (into the plane of FIG. 1) of the screed assembly 14. The screed assembly 14 can compact the loose paving material 30 into a mat 34 behind the paving machine 10.

More particularly, in order to facilitate formation of the mat 34, the paving machine 10 can be outfitted with the main screed plate 13 and additional side screed screed plates (not shown). These side screed plates can be connected to the remainder of the screed assembly 14 via a screed extender. The end gate 14A can be attached to the screed extender. Thus, the end gate 14A can be fixed or otherwise attached to an end of the screed extender and the side screed plate.

In operation, the end gate 14A can be configured to restrict the spread of the paving material 30 beyond specified lateral limits, and therefore, the end gate 14A can be used in combination with the side screed plate to form a desired mat width. The side plate(s) along with the main screed plate 13 can be configured to spread a smooth even layer of the paving material on the prepared roadbed as the mat 34. The weight and/or a vibration of the screed assembly 14 aids in compressing the paving material and performing initial compaction of the paving material layer into the mat 34. To facilitate laying of the paving material 30 as the mat 34, the main screed plate 13 and other plates can be heated to a temperature in the range of about 82< to 171° C. (180° to 340° F.). Heating can assist the paving material 30 in flowing under the main screed plate 13 and side screen plates and can reduce adhesion of the paving material 30 to the main screed plate 13 and side screed plates.

Figure 2:
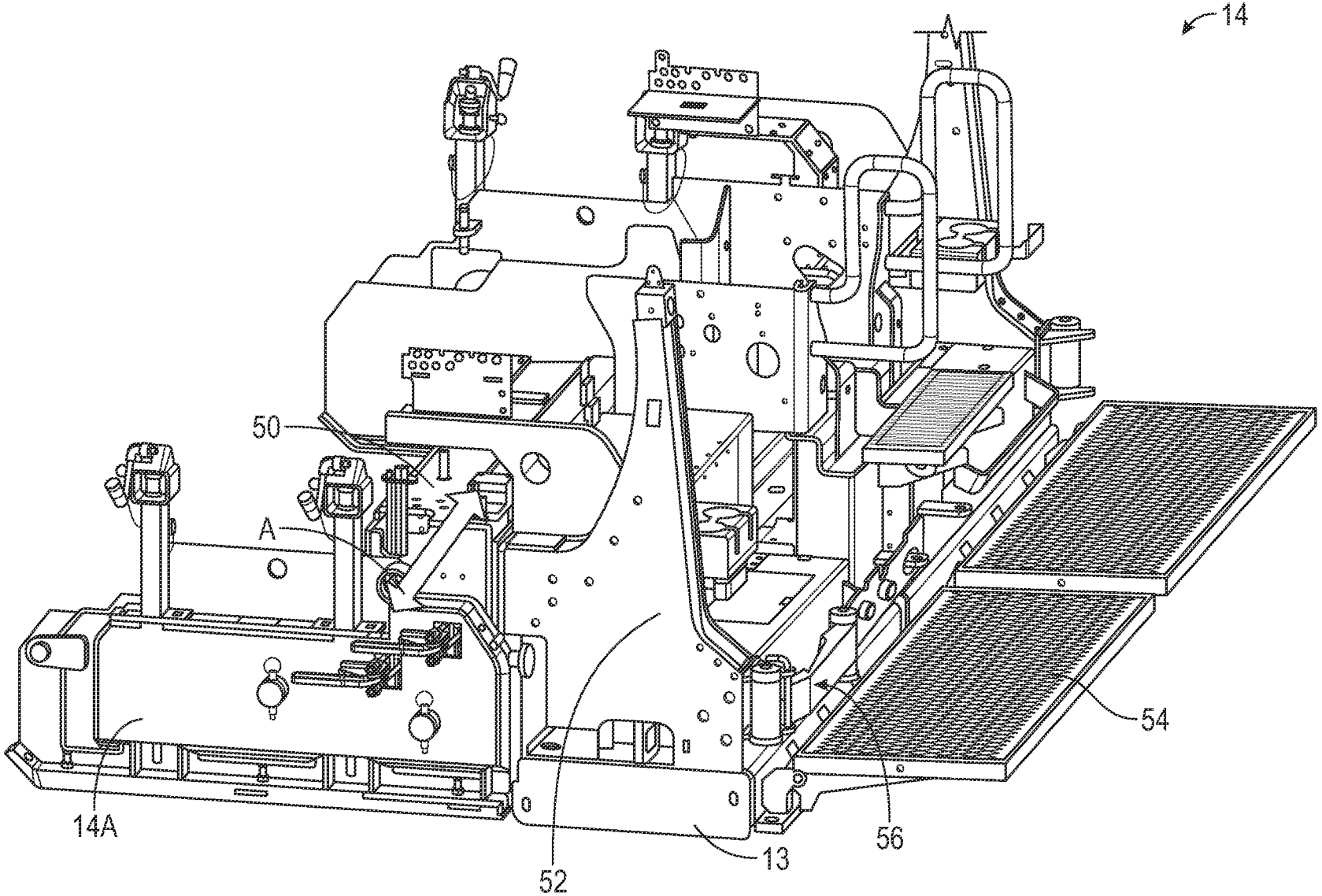
FIG. 2 is a perspective view of the screed assembly with a stowage apparatus folded up into a first position during operating of the paving machine in performing paving according to an example of the present application.
Figure 2A:
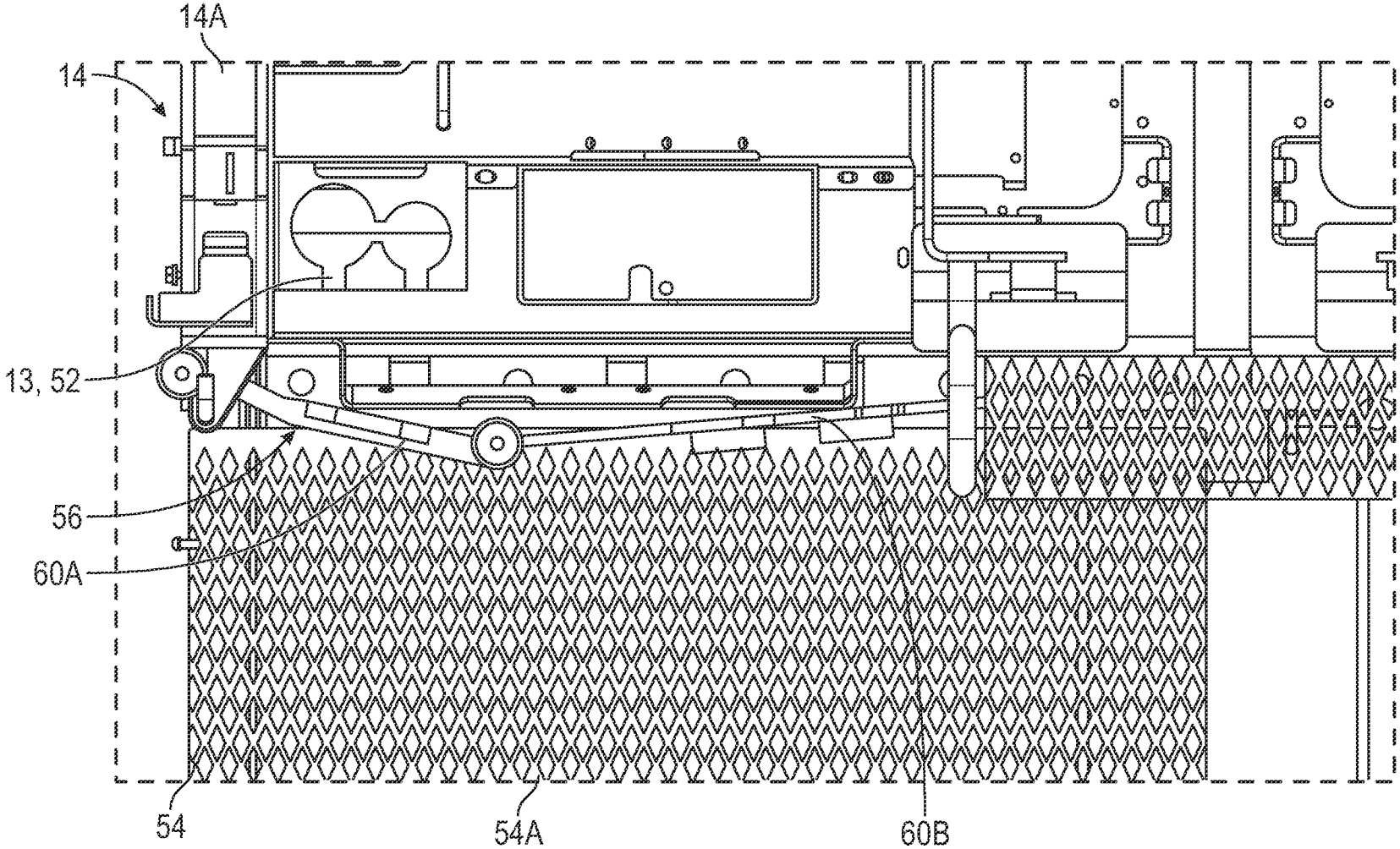
FIG. 2A is a top view of a portion of the screed assembly of FIG. 2 with the stowage apparatus in the first position according to an example of the present application.

FIG. 2 shows a perspective view of the screed assembly 14 according to one example, FIG. 2A shows a top view of the part of the screed assembly 14. FIGS. 2 and 2A show the screed assembly 14 configured for operation to perform paving to create the mat. Thus, an end gate 14A is shown attached to the screed extender 50 in FIG. 2. The screed extender 50 and end gate 14A are not shown in a fully extended position in FIGS. 2 and 2A but it is recognized that these can be extended laterally outward during paving operation to extend the lateral width of the mat as discussed previously. FIGS. 2 and 2A show the screed assembly 14 configured as a front mount screed extension assembly. This arrangement positions the screed extender 50 and parts of the end gate 14A forward of the main screed plate 13. However, other configurations such as a rear mount screed extension assembly are contemplated herein.

As shown in FIGS. 2 and 2A, the screed assembly 14 includes the end gate 14A, the screed extension 50 (shown in FIG. 2 only), a main screed assembly 52 that includes the main screed plate 13, a walkway 54 and a stowage apparatus 56.

The end gate 14A can be selectively connected to the screed assembly 14 via the screed extender 50 as shown in FIG. 2. Such connection can be via a first one or more quick connection mechanisms according to some examples. Operation and construction of the first one or more quick connection mechanisms will be discussed in further detail subsequently.

FIG. 2 shows the screed extender 50 can be extended or retracted laterally as indicated by arrow A. Thus, screed extender 50 and the end gate 14A can be movable to extend and retract relative to the main screed assembly 52 to operably position the end gate 14A relative to the main screed 13. As discussed, the screed extender 50 and the end gate 14A can be positioned forward of the main screed assembly 52 and the main screed plate 13.

FIGS. 2 and 2A show the walkway 54. This can extend generally laterally along a rear side of the main screed assembly 52 rearward of the main screed plate 13. The walkway 54 can be used by personnel during paving operation to monitor laying of the mat and to perform various operations. As shown in FIGS. 2 and 2A the stowage apparatus 56 can be connected at a first end to the main screed assembly 52. Such connection can be via linkage, joint, pin or another type of connection that allows for pivoting movement of the stowage apparatus 56, for example. As best shown in FIG. 2A, the stowage apparatus 56 can include a plurality of linkage arms 60A and 60B and a base. These plurality of linkage arms 60A and 60B can be pivotally or otherwise moveably connected to one another.

The configuration of the stowage apparatus 56 allows the linkage arms 60A and 60B to be pivoted or otherwise moved to fold up or be positioned adjacent one another and/or the main screed assembly 52. Although two linkage arms 60A and 60B are shown, it is contemplated that the stowage apparatus 56 can include relatively more or less linkage arms (e.g., three, four, five, etc). The stowage apparatus 56 can be pivoted or otherwise moved to a first position adjacent the rear of the main screed assembly 52 as shown in FIGS. 2 and 2A. In the first position, the stowage apparatus 56 can be located inward of the walkway 54 or inward of a trailing edge 54A (FIG. 2A) of the walkway 54, for example. In the first position, the stowage apparatus 56 can generally be out of the way of personnel using the walkway 54 during the operation of the paver, for example.

Figure 3:
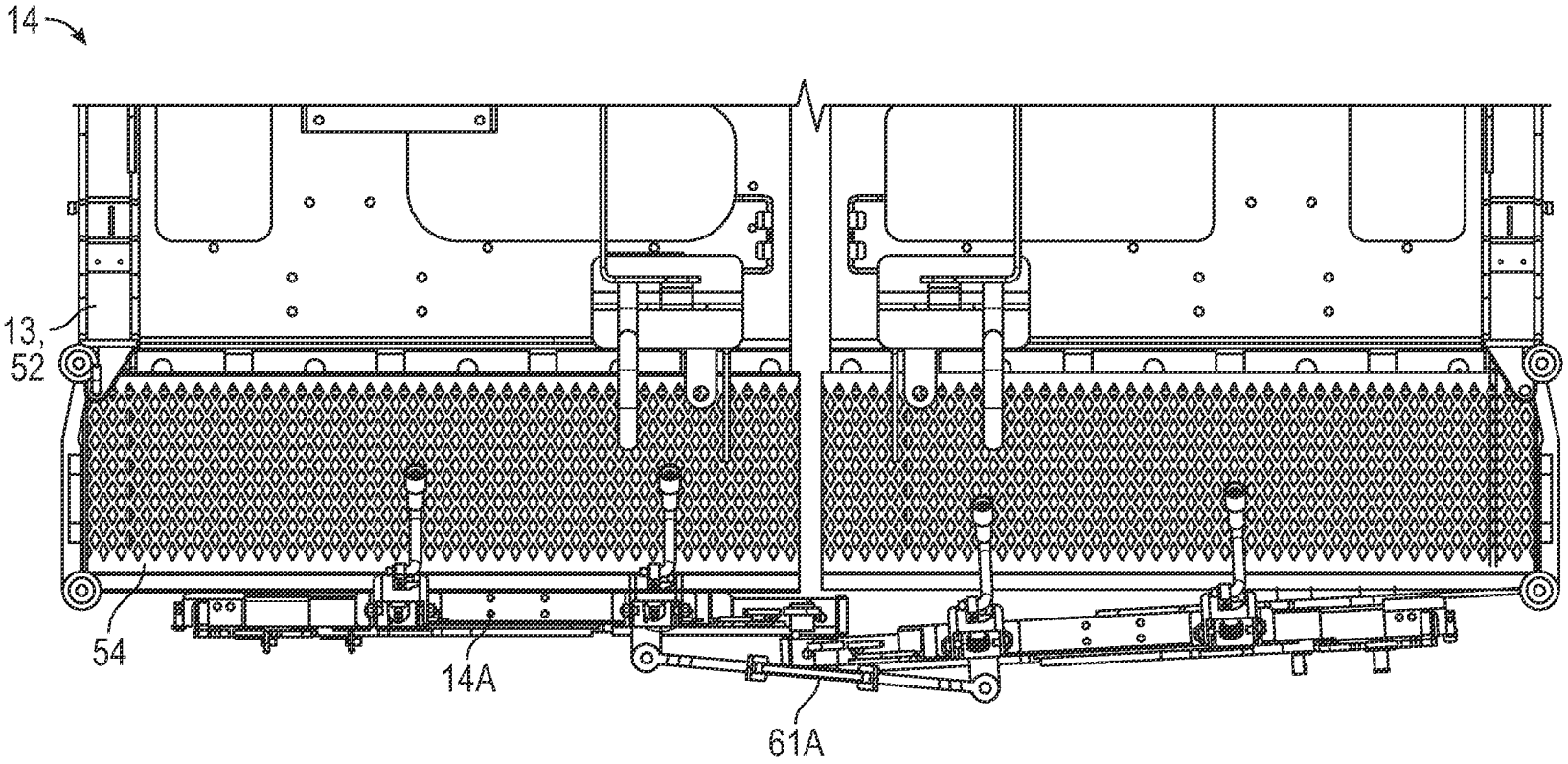
FIG. 3 is a top view of the screed assembly with the stowage apparatus connected to an end gate and the end gate and stowage apparatus moved to a second position for transport of the paver on public roadways according to an example of the present application.
Figure 3A:
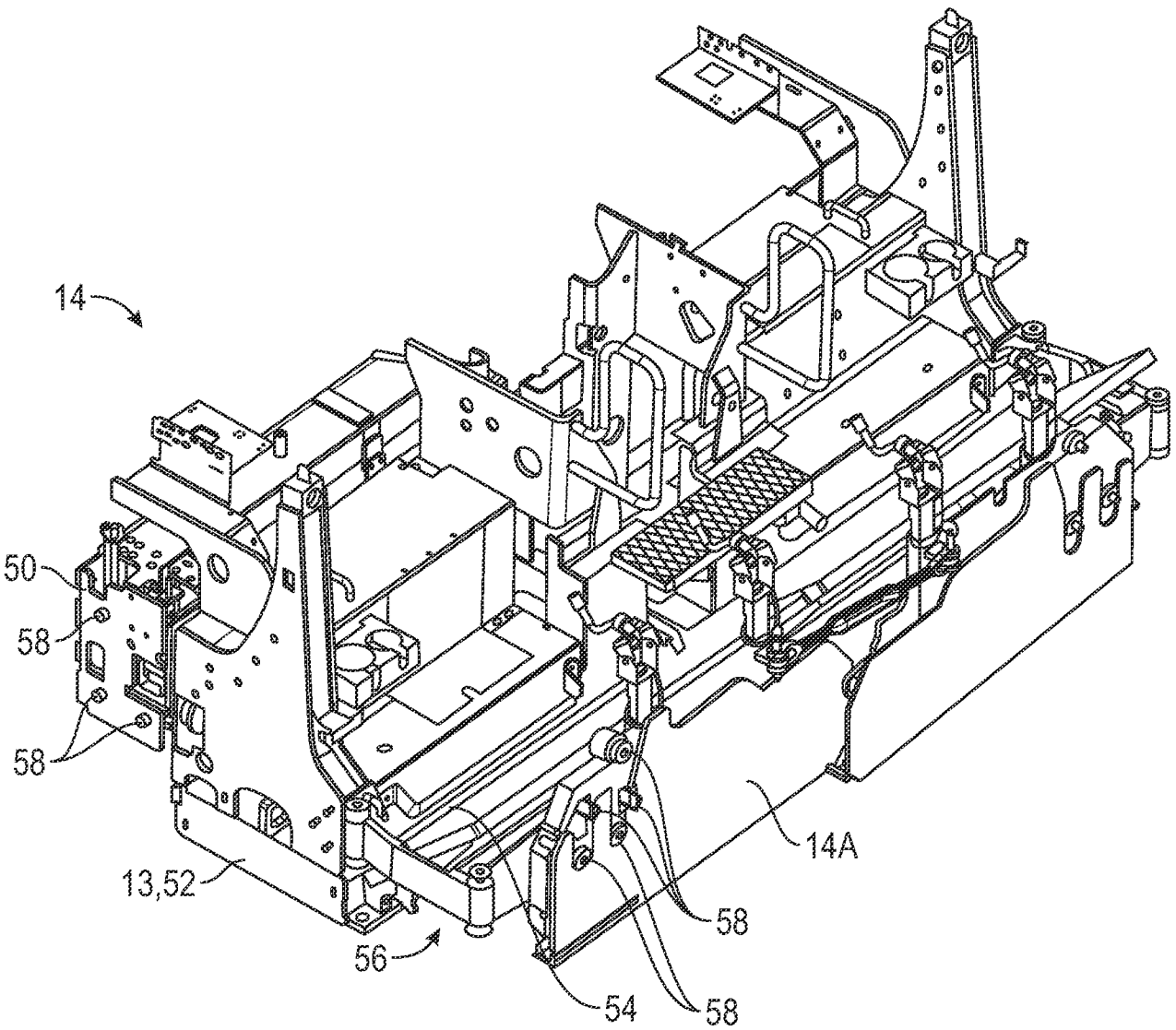
FIG. 3A is a perspective view of the screed assembly of FIG. 3.
Figure 3B:
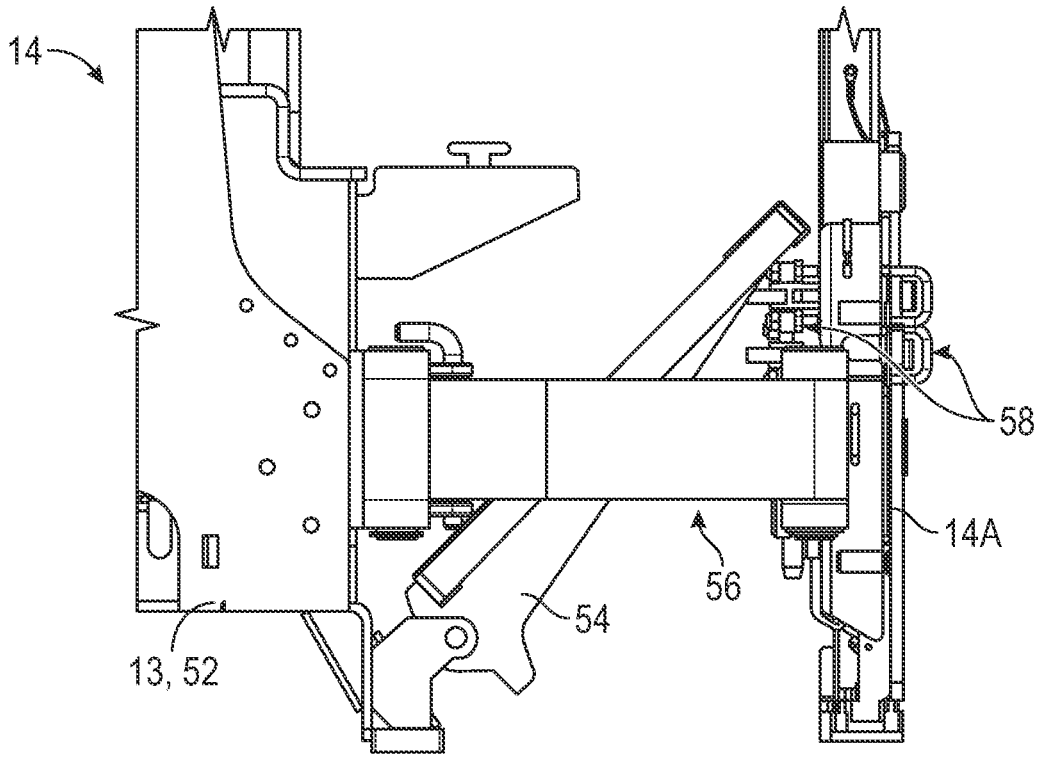
FIG. 3B is a side view of the screed assembly of FIG. 3.

FIG. 3 shows a top view of the screed assembly 14 with the stowage apparatus 56 moved to a second position for transport of the screed assembly 14 and/or paver between working locations. FIGS. 3A and 3B show the screed assembly 14 from a perspective view and a side view, respectively. As shown in FIGS. 3-3B, the end gate 14A has been selectively decoupled (disconnected) from the screed extender 50 and has been selectively connected to the stowage apparatus 56. This connection can be via a second one or more quick connection mechanisms according to some examples. Operation and construction of the second one or more quick connection mechanisms will be discussed in further detail subsequently.

FIGS. 3-3B show various components that make up the first one or more quick connection mechanisms 58. Recall, the first one or more quick connection mechanisms 58 can selectively connect the end gate 14A to the screed extender 50.

In the second position of FIGS. 3-3B, the stowage apparatus 52 and the end gate 14A can be positioned rearward of the main screed assembly 52 and the main screed plate 13, and indeed, rearward of the walkway 54 (which can be tilted up as shown), for example. In this second position, the lateral width of the screed assembly 14 is reduced as the end gate 14A no longer projects laterally therefrom.

In the second position the end gate 14A and the stowage apparatus 56 can be pivoted to a position adjacent a second end gate and a second stowage apparatus from an opposing side of the screed assembly 14. FIG. 3 shows a locking mechanism 61A such as a turnbuckle that can be used to couple the end gate 14A and the second end gate together for transport of the paver. The locking mechanism 61A can also hold a second one of the plurality of arms 60B (FIG. 2A) in the second position. The locking mechanism 61A can comprise a member, a linkage, bar or other component that can be pinned or otherwise coupled to hold the stowage apparatus 56 and/or the end gates in place.

Figure 3C:
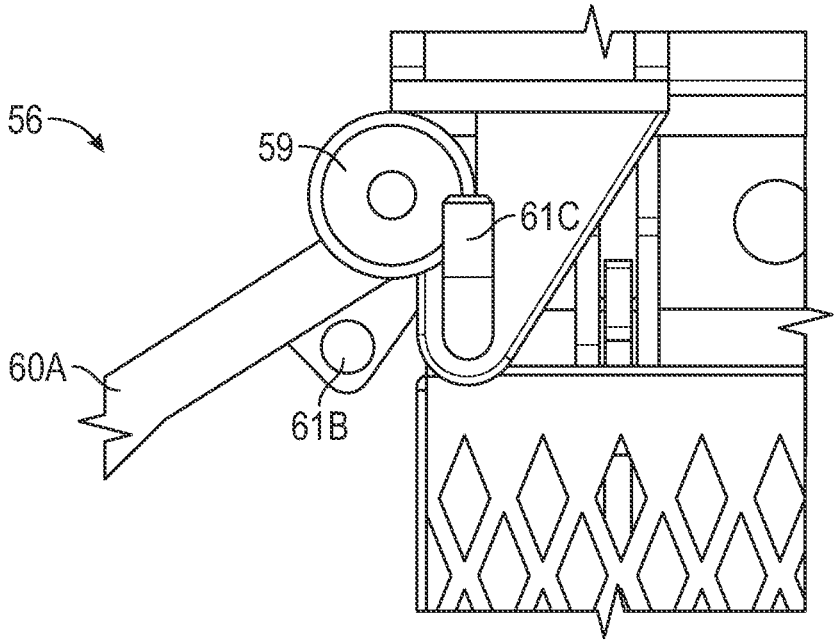
FIG. 3C is a top view of a portion of a locking mechanism for the stowage apparatus according to an example of the present application.

FIG. 3C additionally shows further components of the locking mechanism including a pin 61C and apertures 61B. The pin 61C and apertures 61B can fix the first one of the plurality of arms 60A in the second position as shown in FIGS. 3-3B. FIG. 3C shows the first one of the plurality of arms 60A pivoted out of the second position to illustrate one of the apertures 61B. The arm 60A can form this aperture. A base 59 of the stowage apparatus 56 can firm a second one of the apertures 61B. The apertures 61B are configured to receive the pin 61C. When aligned the apertures 61B receive the pin 61C and lock the first one of the plurality of arms 60A in the desired second position.

Figure 4A:
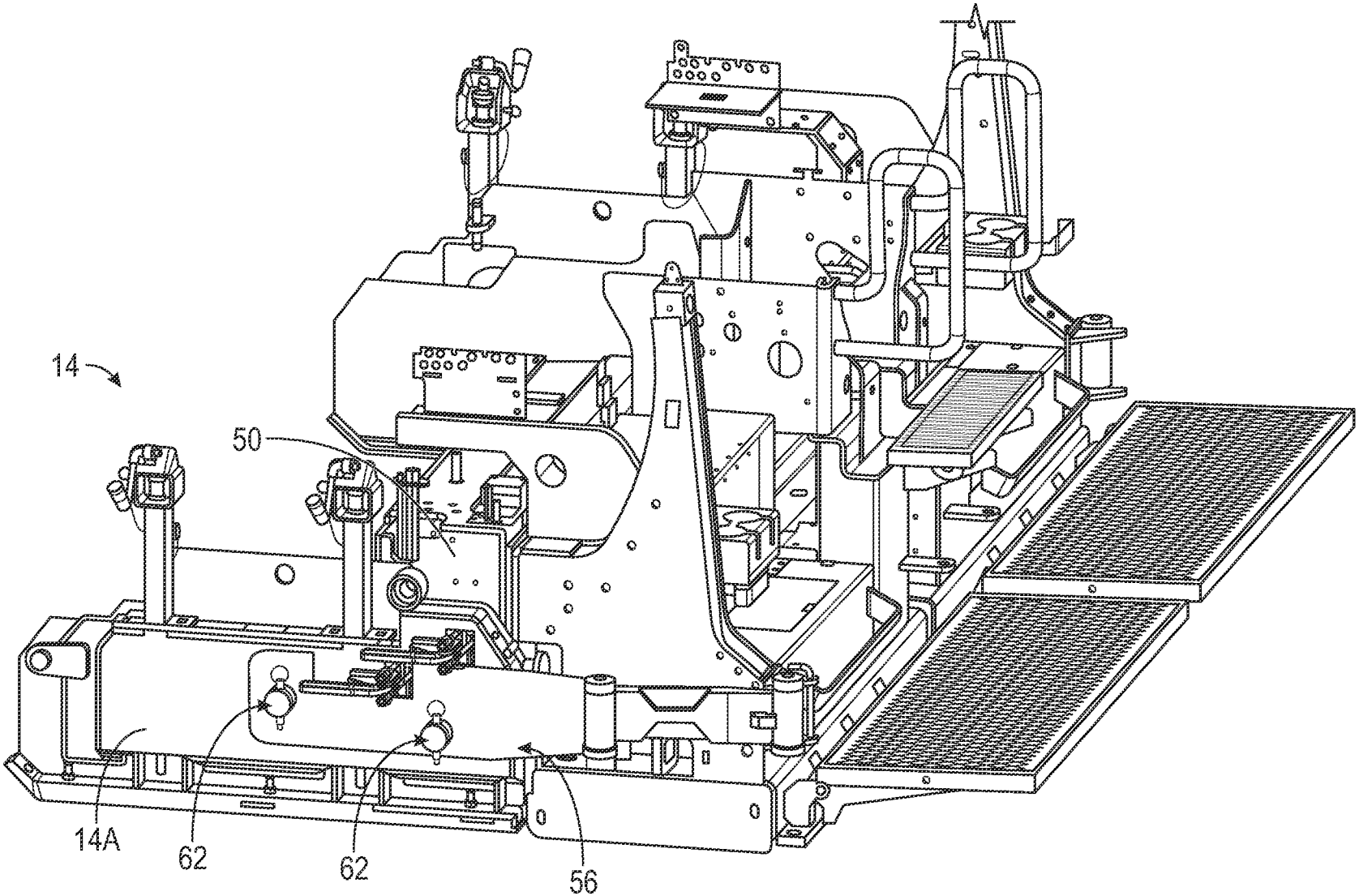
FIG. 4A is a perspective view of the screed assembly with the stowage apparatus connected to the end gate and the end gate and stowage apparatus moved to a third position to bring the end gate adjacent a screed extender according to an example of the present application.
Figure 4B:
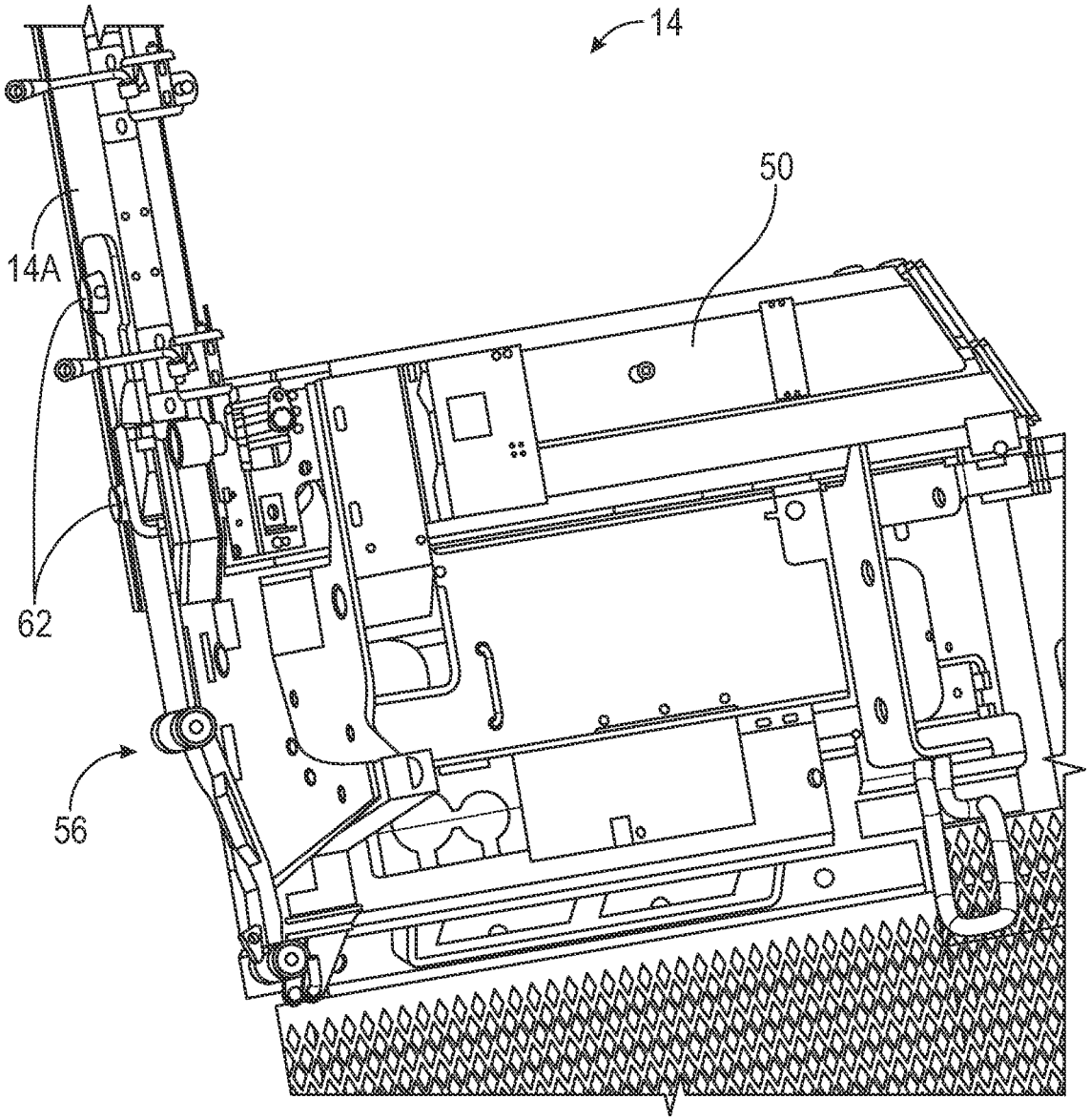
FIG. 4B is a top view of the portion of the screed assembly with the stowage apparatus extended to the third position where the end gate interfaces with and is connected with the screed extender via one or more quick connection mechanisms according to an example of the present application.

FIG. 4A shows a perspective view of the screed assembly 14 with the stowage apparatus 56 moved to a third position. FIG. 4B shows a top view of the screed assembly 14 with the stowage apparatus 56 in the third position. FIGS. 4A and 4B show the stowage apparatus 56 can be used to aid in mounting the end gate 14A with the screed extender 50. In particular, the stowage apparatus 56 can be manipulated to move the end gate 14A to interface with the screed extender 50. In this position, personnel can couple the end gate 14A to the screed extender 50 and can decouple the end gate 14A from the stowage apparatus 56. Such coupling and decoupling can be performed using the first one or more quick connection mechanisms 58 (FIG. 4A) and/or the second one or more quick connection mechanisms 62 as further described herein. However, it is also contemplated that personnel can accomplish such coupling and decoupling using more conventional mechanical connectors such as nuts and bolts that must be tightened using tools, according to some examples.

As shown in FIGS. 4A and 4B, the stowage apparatus 56 can be configured to align the end gate 14A with the screed extender 50 as desired as further described subsequently. FIGS. 4A and 4B show the end gate 14A manipulated to be positioned as desired relative to the screed extender 50 with the stowage apparatus 56 in a third position. In this third position, the end gate 14A interfaces and is aligned with the screed extender 50 as desired such that the end gate 14A can be coupled to the screed extender 50. Coupling and decoupling of the various components can be via the first one or more quick connection mechanisms 58 and the second one or more quick connection mechanisms 62.

Figure 5:
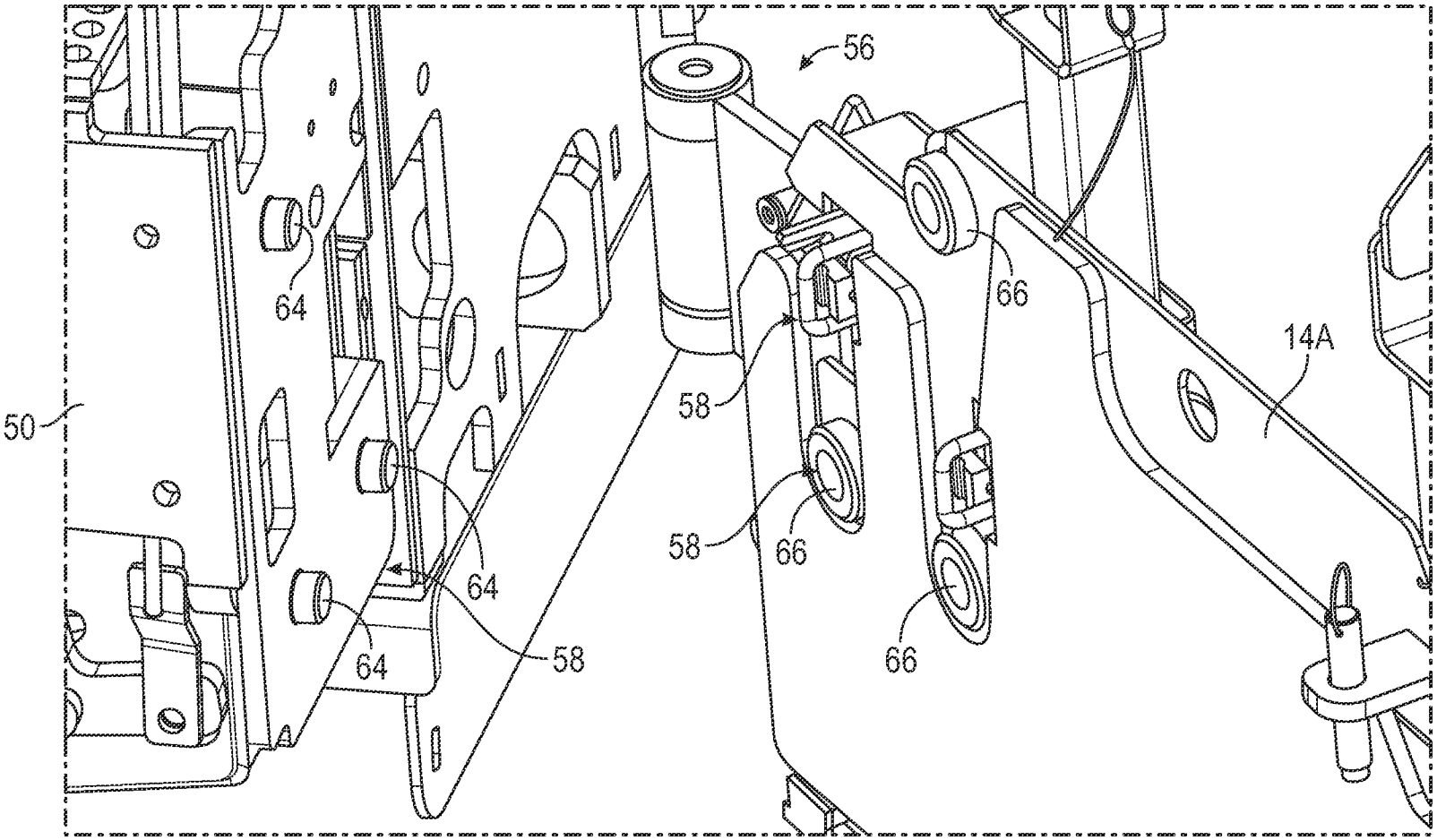
FIG. 5 is a front perspective view of some of the connection mechanisms of the end gate and the screed extender according to an example of the present application.
Figure 5A:
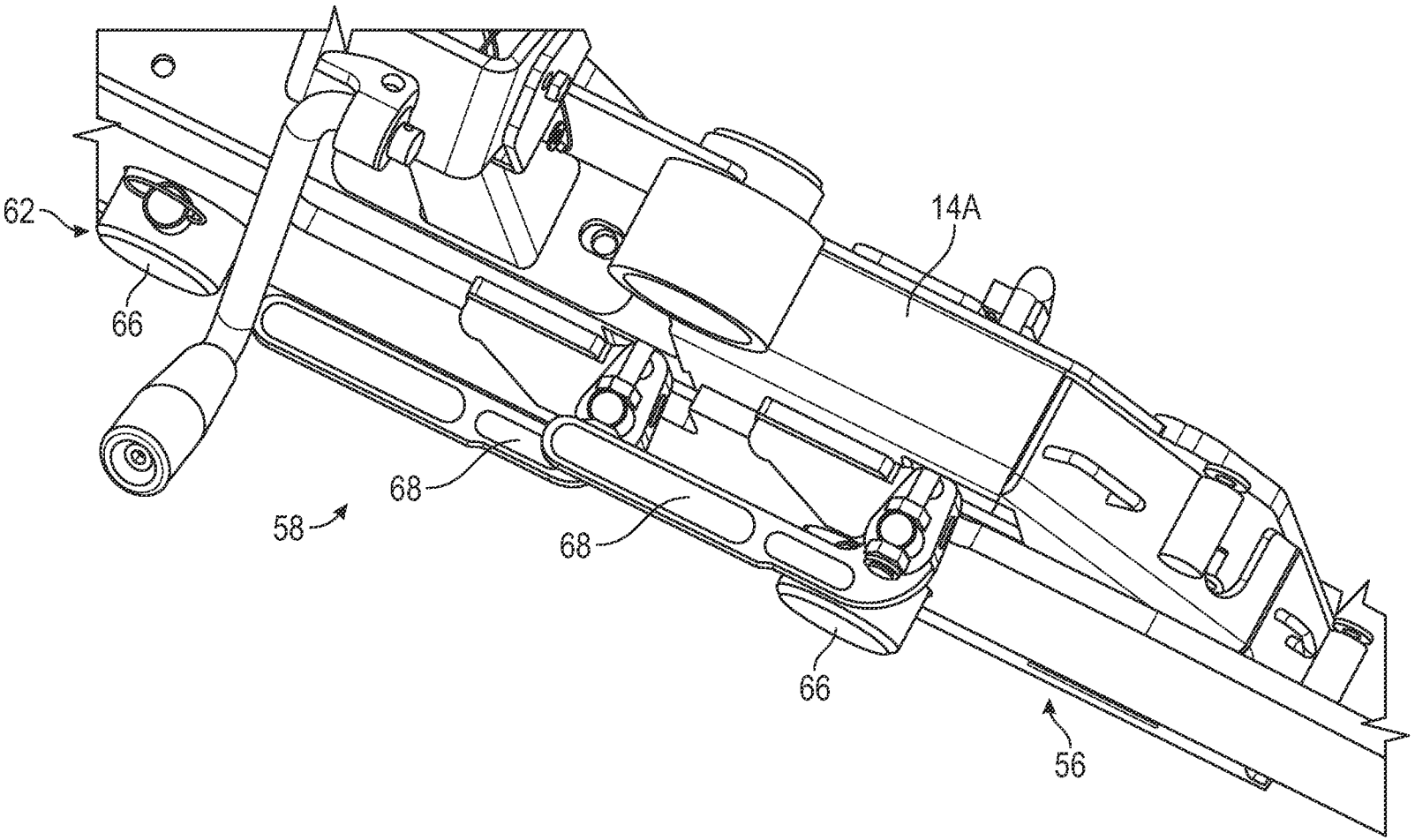
FIG. 5A is a top view of some of the connection mechanisms of the end gate and the stowage apparatus according to an example of the present application.
Figure 5B:
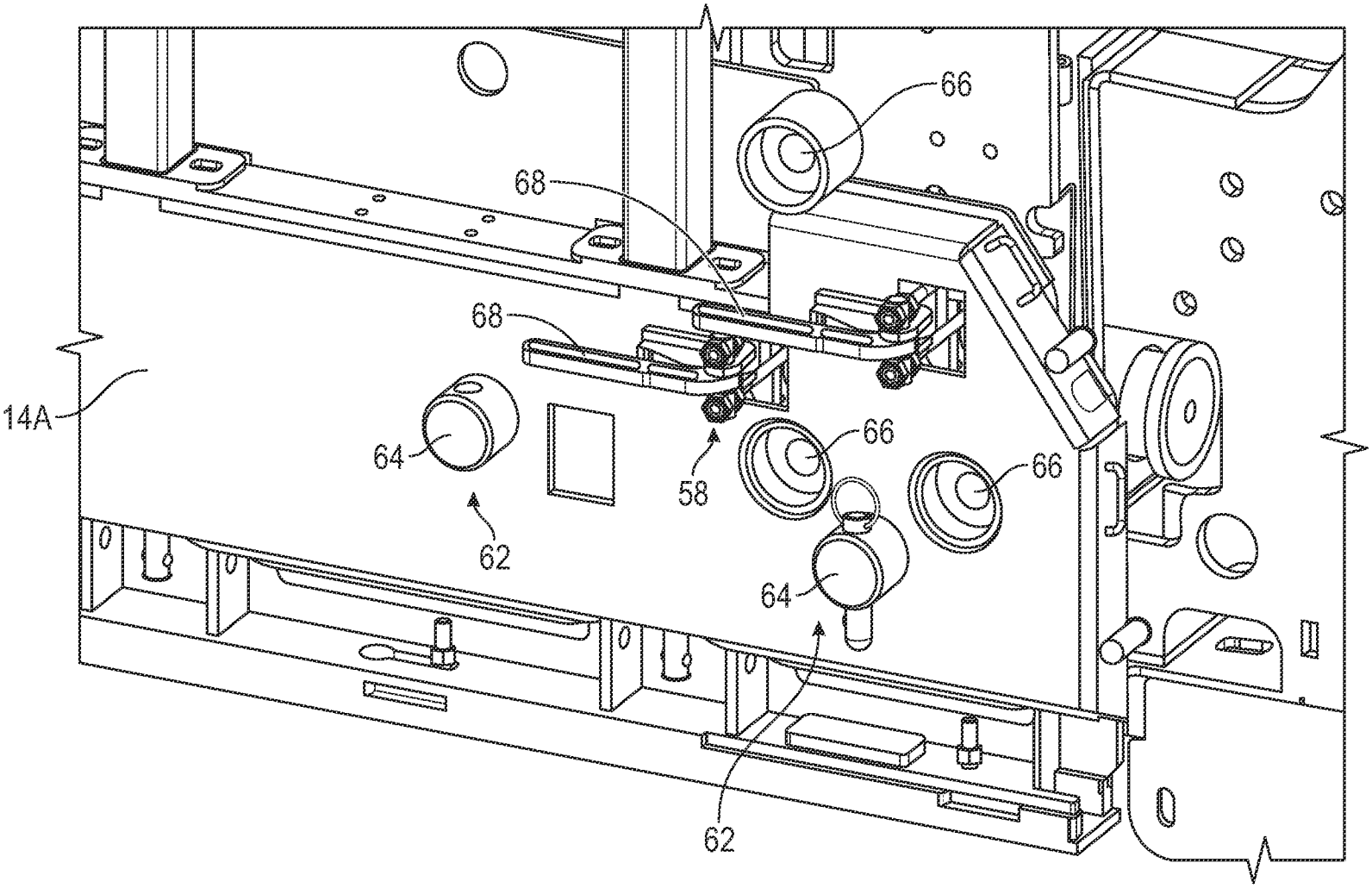
FIG. 5B is a side perspective view of the connection mechanisms of the end gate according to an example of the present application.

Referring now to FIGS. 5-5B, and specifically to FIG. 5, to connect the end gate 14A to the screed extender 50, the first one or more quick connection mechanisms 58 can be properly aligned and then engaged to accomplish connection between the end gate 14A and screed extender 50. The second one or more quick connection mechanisms 62 (FIG. 5A) that couple the end gate 14A to the stowage apparatus 56 can then be disengaged. The stowage apparatus 56 can be retracted and can be pivoted to move to the first position of FIGS. 2 and 2A, for example.

It should be noted that the third position can also be used to connect the end gate 14A to the stowage apparatus 56 and disconnect the end gate 14A from the screed extender 50 in a reverse of the process described above. Once the end gate 14A is mounted to the stowage apparatus 56, the stowage apparatus 56 and the end gate 14A can be moved to the second position as shown in FIGS. 3-3B, for example.

According to one example, the present application contemplates the use of the first one or more quick connection mechanisms 58 and/or the second one or more quick connection mechanisms 62. However, as discussed such mechanisms are not contemplated in all examples. The term "quick" as used herein is used connote connection mechanisms that do not require personnel to utilize tools such as a wrench, drill, etc. to accomplish connection and/or disconnection of the mechanisms. Such quick connection mechanisms can include, but are not limited to pins, bosses, latches, clamps, bayonets, casters, snaps, hooks or the like. Thus, although quick connection mechanisms can accomplish connection or disconnection more rapidly than other connection features in some circumstances, the use of the term "quick connection mechanism" as used herein is intended to encompass connection mechanisms that do not require personnel to utilize tools to accomplish connection and/or disconnection of the mechanisms. Rather, connection and disconnection of the mechanisms can be done by hand.

FIGS. 5-5B shows the first one or more quick connection mechanisms 58 and the second one or more quick connection mechanisms 62 can each include bosses and/or pins 64.

These bosses and/or pins 64 were shown previously in various of the FIGURES. The bosses and/or pins 64 (which can be a single boss or single pin in some cases) can be configured to insert into mating recesses 66 (illustrated in FIGS. 5 and 5B) of the end gate 14A to carry a shear force caused by the weight of the end gate 14A. FIG. 5 shows the bosses and/or pins 64 located on the screed extender 50. Bosses and/or pins 64 can also be located on end gate 14A and/or the stowage apparatus 56 as shown in FIG. 5B. The end gate 14A and/or the stowage apparatus 56 can include recesses 66. However, it is contemplated that such a configuration could be reversed such that the end gate 14A and/or stowage apparatus 56 could have the bosses and/or pins and the screed extender 50 could have recesses. Additionally, a combination of pins/bosses and recesses for one or more of the items is contemplated according to further embodiments. Thus, the end gate 14A for example, can have both bosses and/or pins and recesses that could be used to mate with mating features of the screed extender 50 and the stowage apparatus 56.

In addition to the bosses and/or pins 64 and/or the recesses 66, the first one or more quick connection mechanisms 58 and the second one or more quick connection mechanisms 62 can include a clamp or latch 68 as called out in FIG. 5A specifically. An example of the clamp or latch 68 that can be used in the present application is illustrated throughout the FIGURES but is best shown in FIG. 5B. The clamp or latch 68 can comprise, for example, a latch clamp, toggle clamp, clamping bolt, pneumatic clamp, or the like. The clamp or latch 68 can be configured to engage with one or more features on the screed extender 50

Figure 6A:
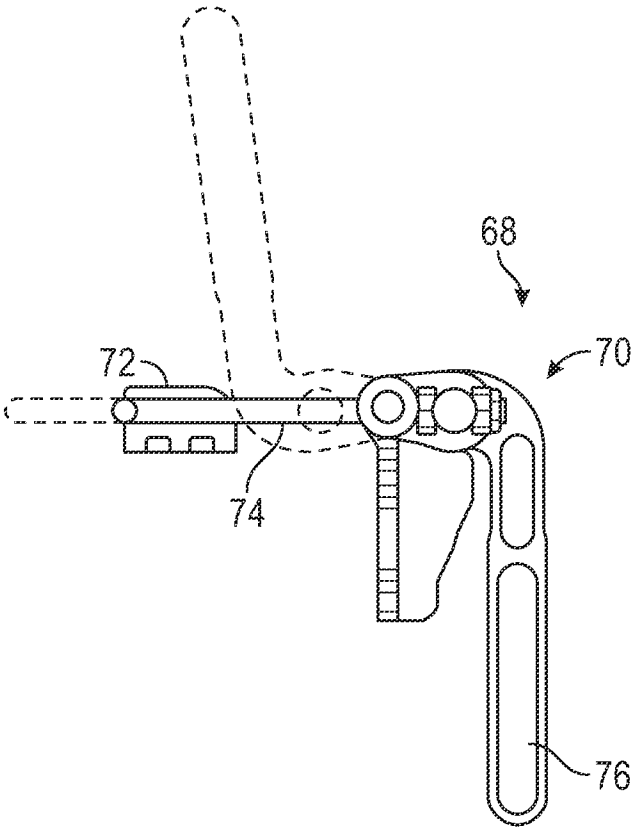
FIGS. 6 and 6A shows perspective and side views of an example of one of the quick connection mechanism, respectively.
Figure 6:
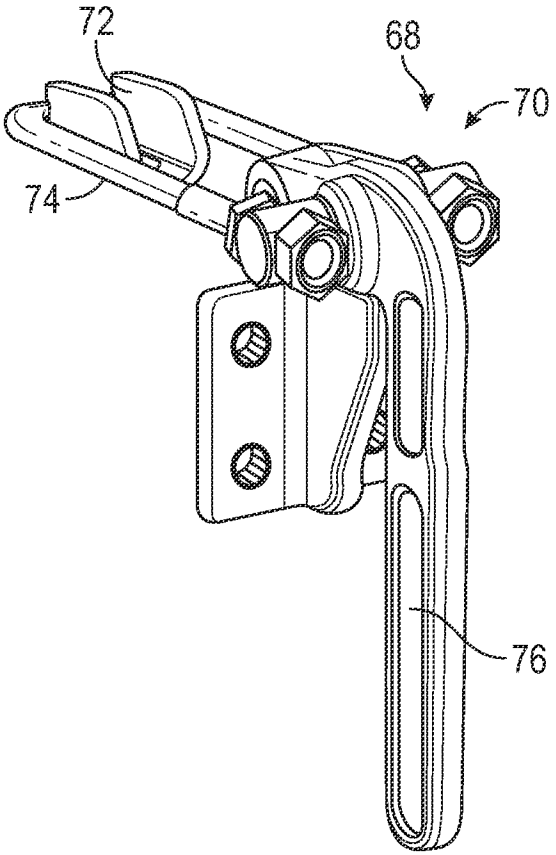

As shown in FIGS. 6 and 6A one example of the clamp or latch 68 in further detail. According to the example of FIGS. 6 and 6A, the clamp or latch 68 can comprise an over-center compression clamp 70. This over-center clamp 70 can include a pulling hook 72 and latch mechanism 74. The latch mechanism 74 can be coupled to a handle 76 via a pin. Movement of handle 76 can extend the position of the pulling hook 72 and latch mechanism 74 as shown in FIG. 6A from a first position where the latch mechanism and element 72, 74 are engaged in compression to a second unlocked/unlatched configuration. In the first position, the latch mechanism 72 and pulling hook 74 apply a compression load on a mating feature (not shown) such a hook or other feature. An example of a suitable over-center clamp 70 or latch clamp comprises a model number MTP-D latch clamp manufactured by ELESA USA Corporation of Twinsburg, Ohio.

INDUSTRIAL APPLICABILITY

Example machines in accordance with this disclosure can be used in a variety of industrial, construction, commercial or other applications including paving. Such pavers can have the screed assembly 14 including main screed plate 13, side screed plates and other components. The side screed plates and the end gate 14A/14A can be retained and positioned by the screed extender 50.

When transporting the screed assembly 14 and/or paver 10 between job site locations, local regulations on machine width may necessitate that the end gate 14A and/or the end gate 14A be removed. The present application contemplates the stowage apparatus 56 can be used to safely retain the end gate 14A and/or 14A behind the main screed 13 to reduce the width of the screed assembly 14 during transport. The stowage assembly 56 can further be configured to fold up out of the way of personnel on the screed assembly 14 when not in use.

The present application further contemplates the use of one or more quick connection mechanisms 58 and/or 62 that can be used in some embodiments. These mechanisms can be used by personnel without the need for additional tools and can facilitate rapid and efficient connection or disconnection of the end gate 14A or 14A. For example, the first one or more quick connection mechanisms 58 can connect the end gate 14A and screed extender 50. The second one or more quick connection mechanisms 62 can connect the end gate 14A and the stowage apparatus 56. The quick connection mechanisms can include bosses and/or pins 66 in addition to other features such as the clamp or lever 70, for example. The quick connection mechanism(s) can reduce the time and complexity associated with removal of the end gate 14A/14A from the screed extender 50 and attachment of the end gate 14A/14A to the stowage apparatus 56 and vice versa.

The quick connection mechanism with the stowage apparatus 56 can further reduce the time and complexity in that the end gate 14A may simply be properly aligned using the stowage apparatus 56 then pushed laterally so as to engage the bosses and/or pins 66. The clamp or lever 70 can then be actuated by hand to engage and to connect the end gate 14A to the screed extender 50 or the stowage apparatus 56. This avoids the need to tighten nuts or insert fasteners and further avoids personnel having to carry the end gate 14A and position the end gate 14A properly for proper fixation using the nuts and bolts or other connection features that require tools.

The above detailed description is intended to be illustrative, and not restrictive. The scope of the disclosure should, therefore, be determined with references to the appended claims, along with the full scope of equivalents to which such claims are entitled. The claims should be considered part of the specification for support purposes.

What is claimed is:

1. A screed assembly for a paver comprising:

an end gate;

a screed extender selectively connected to the end gate via a first one or more quick connection mechanisms, wherein, when connected, the screed extender is configured to operably position the end gate relative to a main screed; and a stowage apparatus including a plurality of linkage arms that are moveably coupled together, the stowage apparatus having a second one or more quick connection mechanisms for selectively coupling the stowage apparatus to the end gate, wherein the stowage apparatus is movable, through the use of the linkage arms, from a first position for transportation of the paver where the end gate is coupled to the stowage apparatus and the end gate is positioned behind the main screed to a second position during operation of the paver where the end gate is decoupled from the stowage apparatus and the stowage apparatus is positioned adjacent the main screed;

wherein the first one or more quick connection mechanisms and the second one or more quick connection mechanisms are selected from a group consisting of bosses, clamps, pins, over-center compression clamps, latches, bayonets, casters, snaps, and hooks.

2. The paver of claim 1, wherein the stowage apparatus is movable to a third position to interface the end gate with the screed extender to allow the end gate to be selectively connected to the screed extender.

3. The paver of claim 1, wherein the first one or more quick attachment mechanisms and the second one or more quick attachment mechanisms comprise a combination of a clamp and a boss or pin.

4. The paver of claim 1, wherein the screed extender is mounted forward of the main screed.

5. The paver of claim 1, wherein at least two of the linkage arms are configured to be pivoted to fold up adjacent one another when in the second position.

6. The paver of claim 5, wherein in the second position the stowage apparatus is located inside a trailing edge of a rear walkway of the paver which is located rearward of the main screed.

7. The paver of claim 1, wherein the stowage apparatus is pivotally coupled to the main screed at a first end thereof and includes one or more locking mechanisms to lock the stowage apparatus in the second position.

8. A system for a paver, comprising:

a main screed;

an end gate;

a screed extender configured to selectively couple with the end gate;

a stowage apparatus including a plurality of linkage arms that are moveably coupled together, the stowage apparatus is configured to selectively couple with the end gate and the main screed, wherein the stowage apparatus is configured to be movable from a first position for transportation of the paver where the end gate is coupled to the stowage apparatus and the end gate is positioned behind the main screed to a second position during operation of the paver where the end gate is decoupled from the stowage apparatus and the stowage apparatus is positioned adjacent the main screed; and a plurality of quick connection mechanisms including at least one or more of: bosses, clamps, pins, over-center compression clamps, latches, bayonets, casters, snaps, and hooks;

wherein the quick connection mechanisms selectively couple at least one of the end gate to the screed extender or the end gate to the stowage apparatus.

9. The system of claim 8, wherein the stowage apparatus is configured to be movable to a third position to interface the end gate with the screed extender to allow the end gate to be selectively connected to the screed extender.

10. The paver of claim 8, wherein in the second position the stowage apparatus is located inside a trailing edge of a rear walkway of the paver which is located rearward of the main screed.

11. The paver of claim 8, wherein the screed extender is mounted forward of the main screed.

12. The paver of claim 8, wherein the plurality of quick attachment mechanisms include one or more over-center compression clamps.

13. The paver of claim 8, wherein the plurality of linkage arms are configured to be pivoted and locked by one or more locking mechanisms when in the second position.

14. A method of stowing an end gate of a screed assembly for transport, the method comprising:

connecting the end gate to a stowage apparatus using one or more quick connect mechanisms selected from a group consisting of bosses, clamps, over-center compression clamps, or pins;

disconnecting the end gate from a screed extender; and pivoting the stowage apparatus to position the end gate behind the main screed using linkage arms.

15. The method of claim 14, wherein connecting the end gate to the stowage apparatus using the one or more quick connect mechanisms includes clamping the end gate to the stowage apparatus and inserting one or more bosses of the end gate or stowage apparatus in one or more recesses of the end gate or stowage apparatus.

16. The method of claim 14, wherein connecting the end gate to the stowage apparatus using the one or more quick connect mechanisms includes clamping the end gate to the stowage apparatus using one or more over-center compression clamps.

17. The method of claim 14, wherein disconnecting the end gate from the screed extender includes unlatching the end gate from the screed extender and removing one or more bosses of the end gate or screed extender from one or more recesses of the end gate or screed extender.

18. The method of claim 14, wherein disconnecting the end gate from the screed extender includes unlatching one or more over-center compression clamps that couple the end gate to the screed extender.

19. The method of claim 14, further comprising:

connecting a first end of the stowage apparatus to a rear of the main screed forward of a rear walkway; and pivoting the stowage apparatus into a position where a second end of the stowage apparatus is interfacing with the end gate.

20. The method of claim 19, wherein connecting the stowage apparatus to the main screed includes locking the linkages arms using one or more locking mechanisms to lock the stowage apparatus in the second position.

* * * * *